US005147224A

United States Patent [19]

Tan et al.

[11] Patent Number: 5,147,224

[45] Date of Patent: Sep. 15, 1992

[54] ELECTRICAL CONNECTOR WITH CONDUCTIVE MEMBER ELECTRICALLY COUPLING CONTACTS AND FILTER COMPONENTS

[75] Inventors: Haw-Chan Tan, Diamond Bar; Nobbert Yu, Culver City; Yuan-Chieh Lin, Fountain Valley, all of Calif.

[73] Assignee: Foxconn International, Inc., Sunnydale, Calif.

[21] Appl. No.: 707,058

[22] Filed: May 29, 1991

[51] Int. Cl.[5] ..... H01R 13/66

[52] U.S. Cl. ..... 439/620; 333/182; 439/95

[58] Field of Search ..... 439/607, 620, 95; 333/181-185

[56] References Cited

U.S. PATENT DOCUMENTS

| | | | |
|---|---|---|---|
| 3,550,067 | 12/1970 | Hansen . | |
| 3,710,285 | 1/1973 | Schor et al. | 333/79 |
| 3,957,337 | 5/1976 | Damiano . | |
| 4,020,430 | 4/1977 | Vander Heyden | 333/79 |
| 4,215,326 | 7/1980 | Hollyday | 333/182 |
| 4,222,626 | 9/1980 | Hollyday et al. | 333/182 |
| 4,265,506 | 5/1981 | Hollyday | 333/182 |
| 4,371,226 | 2/1983 | Brancaleone | 439/620 |
| 4,500,159 | 2/1985 | Briones et al. . | |
| 4,589,720 | 5/1986 | Aujla et al. | 333/185 |
| 4,653,838 | 3/1987 | Ney et al. | 333/185 |
| 4,660,907 | 4/1987 | Belter | 439/620 |
| 4,679,013 | 7/1987 | Farrar et al. | 333/182 |
| 4,707,048 | 11/1987 | Gliha et al. | 439/620 |
| 4,804,332 | 2/1989 | Pirc | 439/620 |
| 4,988,313 | 1/1991 | Castlebury | 439/621 |

*Primary Examiner*—Neil Abrams

*Attorney, Agent, or Firm*—Flehr, Hohbach, Test, Albritton & Herbert

[57] ABSTRACT

An electrical connector assembly includes a first insulative housing (12) which defines a plurality of first passages (14) extending therethrough for receiving corresponding electrical conductive members (22). The first insulative housing (12) also defines a corresponding number of apertures (42) thereof for receiving electrical filtering components (30), such as a TVS chip, and each apertures (42) is parallel to and communicates with one side of the first passage (14). A second insulative housing (16) defines a plurality of second passages (38) corresponding to the first passages (14) of the first insulative housing (12) for receiving the same conductive members (22), and also defines a corresponding number of cavities (40) thereof for receiving conductive bridge members (34). Each conductive bridge member (34) is dimensioned for fixedly abutting against the filtering component (30) and being clipped (48) by the intermediate contact region (28) of conductive member (22) without welding or bonding to make the communication between the electrical filtering component (30) and the conductive member (22). At the same time each conductive bridge member (34) provides a means for preventing the transference of torsional forces or axial movement from the conductive member (22) to the electrical filtering component (30).

16 Claims, 5 Drawing Sheets

ELECTRICAL CONNECTOR WITH CONDUCTIVE MEMBER ELECTRICALLY COUPLING CONTACTS AND FILTER COMPONENTS

BACKGROUND OF THE INVENTION

1. Field of the Invention

The present invention relates to electrical connector assemblies and particularly to connector assemblies with programmable elements.

2. Description of the Related Art

The invention described and illustrated herein is related to copending commonly assigned application Ser. No. 07/544,106 filed May 26, 1990 and commonly assigned application Ser. No. 07/592,277 filed Sep. 28, 1990.

Electrical connector assemblies are well known which include an insulator member having a plurality of elongated passages extending between external facing and internal facing portions of the member. Individual conductive members can be inserted into the passages in order to provide conductive paths between the external and internal facing portions.

Such earlier connector assemblies are programmable. That is, individual conductive members may be inserted into corresponding passages or not, depending upon the use of the connector. A conductive path is formed when a conductive member is inserted into a passage. Conversely, no conductive path is formed where a conductive member is not inserted into a passage.

Each separate conductive member inserted into a passage of the insulator member provides a separate conductive path between the external facing and the internal facing sides of the insulative member. Thus, each separate conductive member can provide a separate electrical connection between a separate external connector on the external facing side of the insulator member and a corresponding separate internal connector on the internal facing side of the insulator member. In the past, typical earlier conductive members included a receiving portion at one end thereof for mechanically engaging and electrically contacting an external pin connectors. Additionally, at an opposite end of such typical earlier conductive member a pin portion was formed.

The programming of such earlier electrical connectors involved sliding insertion of the conductive members into corresponding passages in the insulative member. Usually, the width of the passages was sized to accommodate the widest dimension of the conductive member. Moreover, insertion ordinarily was made through the internal facing side of the insulating member.

One problem experienced by such earlier connectors has been potential electrical interference between the conductive members when inserted in the passages. A gap often existed between the narrower pin portion and an insulative member passage which was sized wide enough to permit insertion of the wider receiving portion of the conductive member. This gap could potentially permit electrical interference to exist between different conductive members.

Another problem confronted by earlier electrical connector assemblies has been the problem of electrostatic discharge (ESD) and filtering. In order to accommodate such ESD and filtering, for example, an electrical contact ordinarily was made between individual conductive members and corresponding individual electrical filtering component such as a capacitor, resistor, varistor or diode. The individual electrical filtering component, in turn, typically was electrically coupled to a grounded conductor, for example. Thus, unwanted electrical interference could be filtered out.

In some earlier connector assemblies a conductor bridge provided electrical connection between an individual conductive member and a filtering component. Typically, such a conductive bridge was inserted into a gap in the insulator member between a corresponding conductive member and filtering component. Unfortunately, the gap between the conductor bridge and the insulative member potentially could contribute to electrical interference between conductive members. Moreover, such conductive bridges potentially could suffer from mechanical instability.

Thus, there has been a need for a programmable electrical connector assembly in which there is reduced electrical interference between conductive members and improved mechanical stability. The present invention meets these needs.

SUMMARY OF THE INVENTION

The invention in terms of broad inclusion provides a programmable electrical connector assembly comprising a plurality of individual conductive members, each conductive member including an elongated pin output portion formed at one end, an input receiving portion formed at an opposing end thereof and an intermediate contact region disposed between the pin output portion and said input receiving portion. In addition, a first insulative housing defining a plurality of individual first passages houses the conductive members. Each first passage extends therethrough and each is dimensioned to axially accept an individual input receiving portion of an individual conductive member. A second insulative housing is secured to the first housing and defines a plurality of second passages. Each second passage extends therethrough and each is aligned with a corresponding one of the first passageways. Further, each second passage is dimensioned to axially receive only an individual elongated pin output portion of an individual conductive member. Finally, there is provided a plurality of electrical filtering components, and a plurality of individual conductive bridge members electrically coupled to provide electrical communication between individual of said electrical filtering components and individual intermediate contact regions of corresponding conductive members.

In the presently preferred embodiment, each conductive bridge member is adapted for abutting against an electrical component and being releasably secured to an intermediate contact region of the conductive member to provide electrical communication between the electrical component and the conductive member. At the same time each conductive bridge member limits the transference of torsional forces or axial movement from the individual conductive members to the individual electrical components.

In a further aspect of the present embodiment, grounding plate covering the electrical components is positioned on the front surface of the first insulative housing, and sandwiched by the first insulative housing and a metallic shell.

The present invention solves the above-mentioned shielding disadvantages by providing a programmable electrical connector which reduces the unnecessary spaces that facilitate electrical interference. Moreover, the structurally more solid configuration of the connector enhanced stability between all electrical contact points.

DETAILED DESCRIPTION OF THE PREFERRED EMBODIMENT

Reference will now be made in detail to the preferred embodiments of the invention. While the present invention has been described with reference to a few specific embodiments, the description is illustrative of the invention and is not to be construed as limiting the invention. Various modifications may occur to those skilled in the art without departing from the true spirit and scope of the invention as defined by the appended claims.

Figure 1:
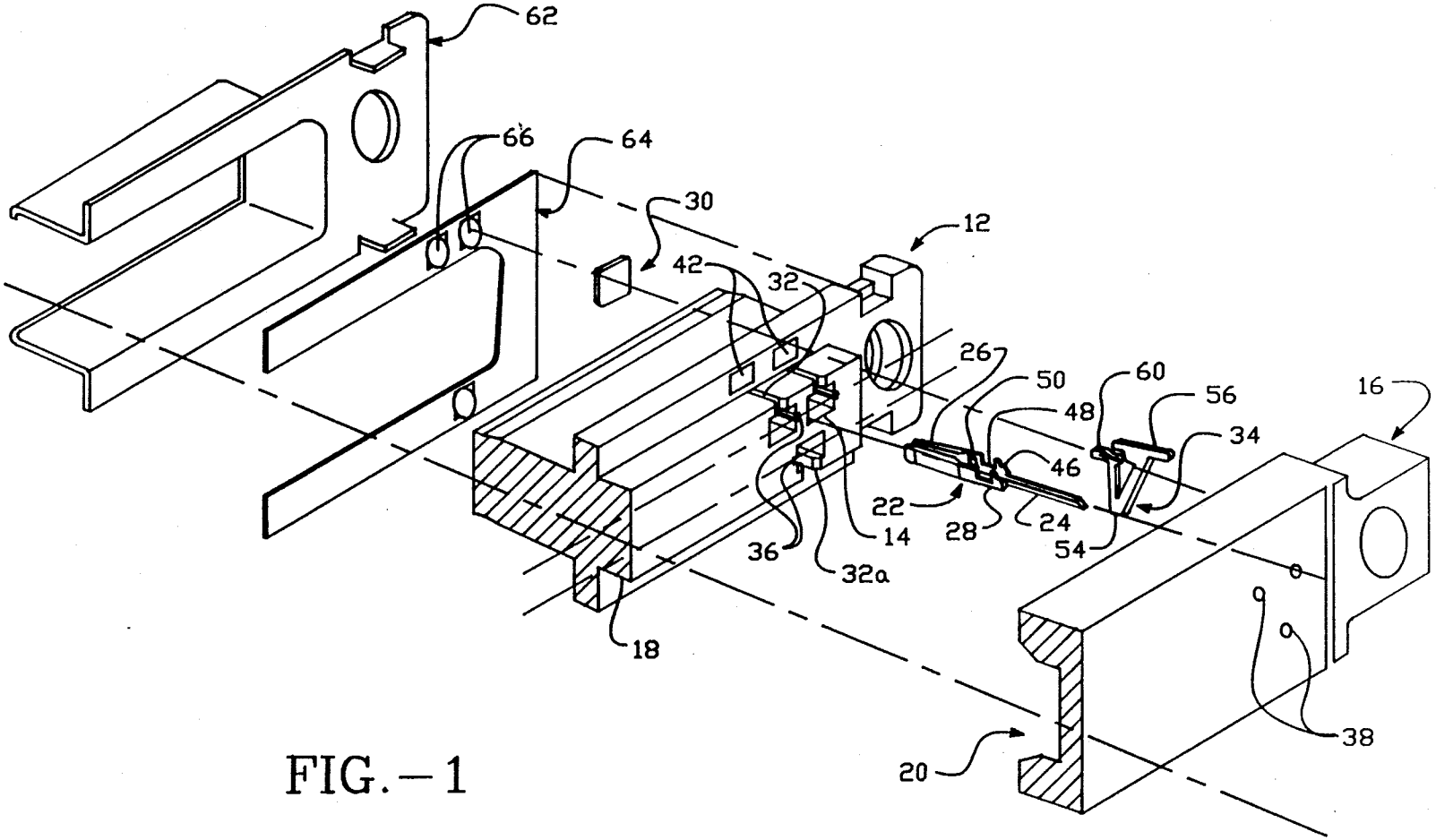
FIG. 1 is an exploded perspective view of a presently preferred embodiment of electrical connector assembly in accordance with the present invention.
Figure 2:
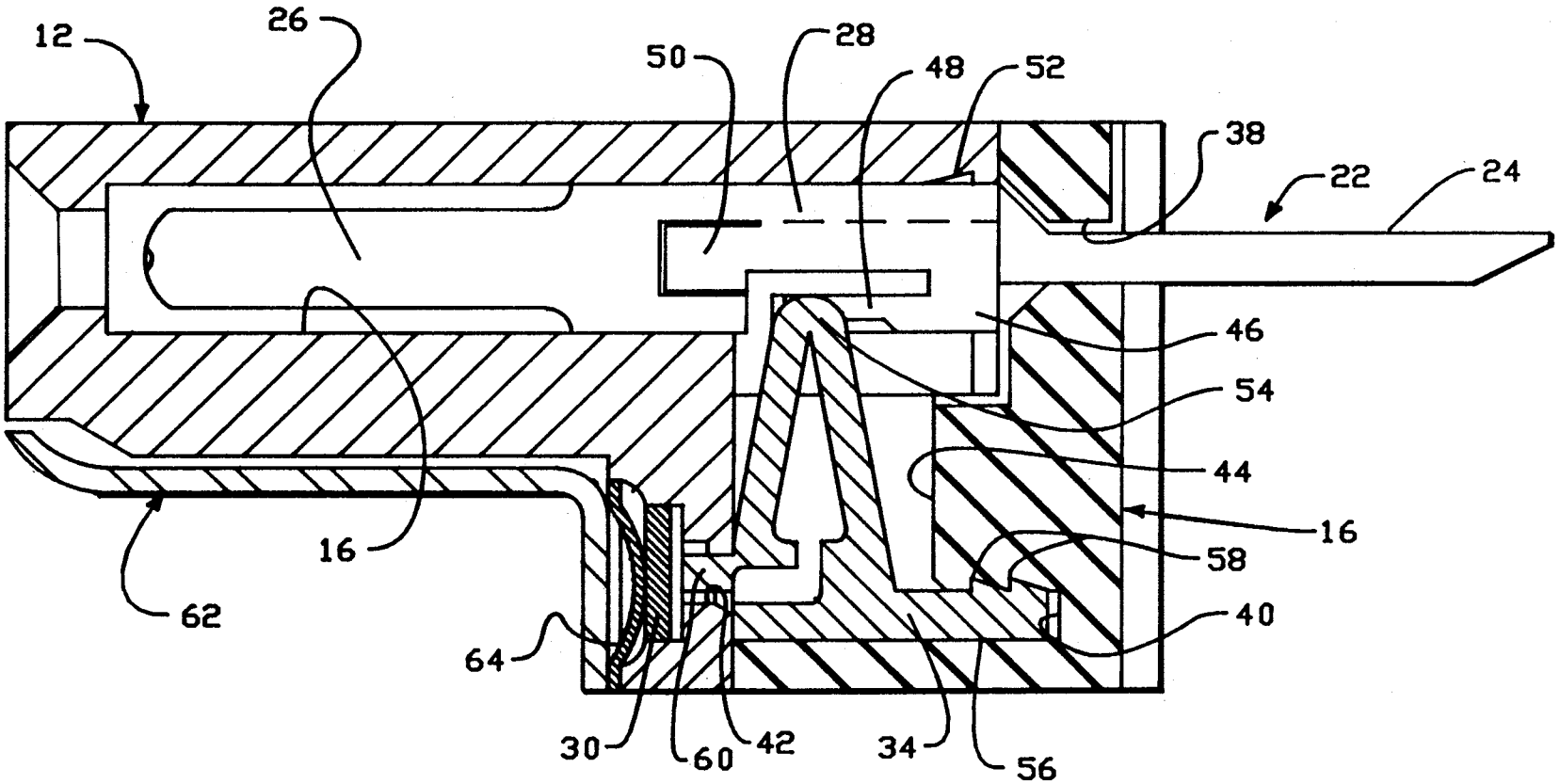
FIG. 2 is a vertical sectional view of the connector of FIG. 1.
Figure 3:
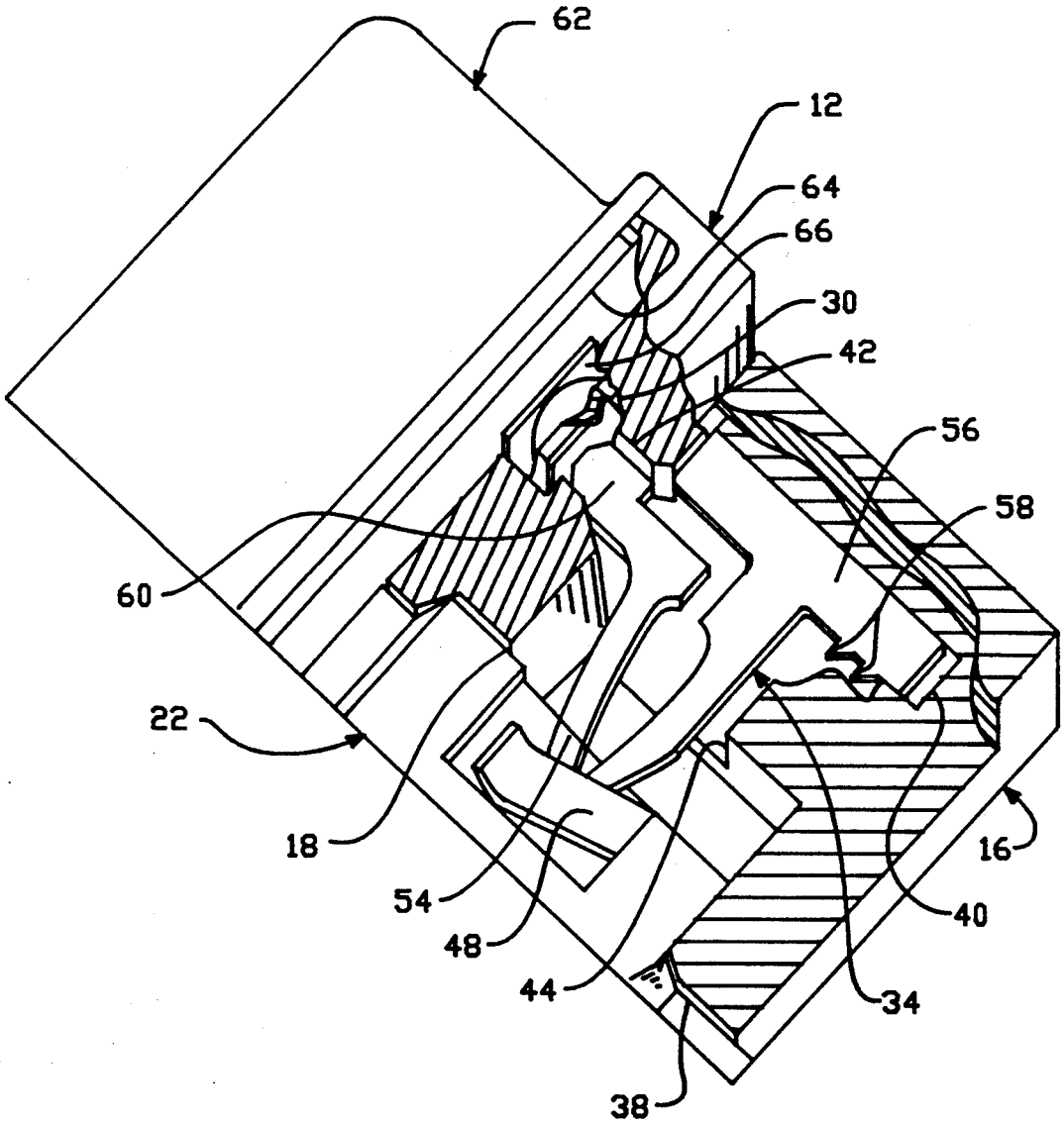
FIG. 3 is a cutaway perspective top view of the connector of FIG. 1.

Turning now to the drawings, wherein like components are designated by like reference numerals throughout the various figures, attention is directed to FIGS. 1, 2, and 3, where the subject connector assembly 10 includes a first insulative housing 12 defining therethrough a plurality of first passages 14, and a second insulative housing 16 mateably secured to the first housing 12. In the preferred embodiment, the first housing 12 includes an upstanding central island 18 transversely disposed to the first passages and positioned in a direction facing the second insulative housing 16. Similarly, second housing 16 includes a transversely mounted recess 20 dimensioned to mateably engage with the upstanding central island 18. As will be discussed in greater detail below, the standard coupling between first housing 12 and second housing 16 provide superior insulation between the passages 14 as compared to the prior art discussed heretofore.

The first passages 14 of first insulative housing 12 are formed for receiving the corresponding conductive members 22. Briefly, as may be viewed in FIG. 1, conductive member 22 comprises an elongated pin output portion 24, a pin input receiving portion 26, and an intermediate contact region 28.

In the preferred form, first insulative housing 12 contains a corresponding number of apertures 42 for receiving a corresponding number of electrical components 30 which extend through the first housing 12 and are parallel to the first passages 14. A portion of each first passage 14 has a narrow upward opening 32 providing communication for a conductive bridge member 34 to be positioned therethrough. Upon mateable coupling between first housing 12 and second housing 16, a portion of conductive bridge member 34 slidably inserts into narrow opening 32, as seen in FIG. 1. Therefore, the narrow dimensions of opening 32 act to shield the conductive members 34 from one another.

A groove 36 is positioned on one side of the first passage 14 and a step (not shown) is formed at its inner end to stop the forward movement of the conductive member 22 within the first passage 14. Similarly, as just stated, the conformation of first passage 14 to the intermediate contact region 28 of conductive member 22 provides superior stability and shielding between all components.

Figure 4:
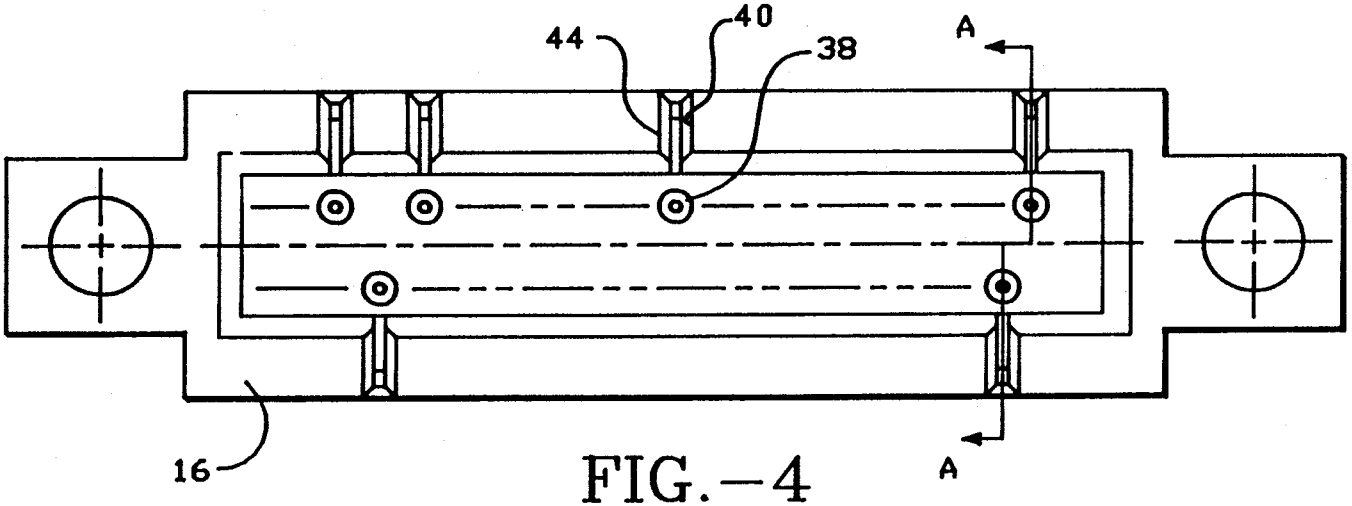
FIG. 4 is a front view of the spacer.
Figure 5:
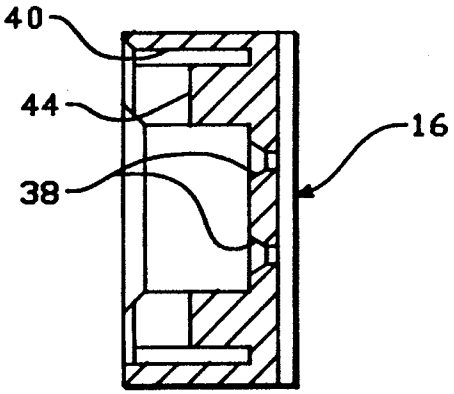
FIG. 5 is a vertical sectional view of the spacer.

Referring now to FIGS. 4 and 5 and to previous FIGS. 1-3, the second insulated housing 16 contains a plurality of second passages 38 corresponding to the first passages 14 of the first housing 12. As will be discussed in greater detail below, the conductive bridge members 34 are securely housed in the second housing 16 so as to provide a more stable electrical contact is provided between the conductive members 22, the conductive bridge members 34 and the filtering components 30. However, it is noted here that conductive bridge member 34 could just as easily have been mounted in the first housing 12 without departing from the true spirit of the invention.

In the second insulative housing 16, shown in FIG. 2, a plurality of cavities 40 are correspondingly positioned to align the conductive bridge members 34 with the corresponding apertures 42 of the first insulative housing 12 and also in parallel with the second passages 38. A slot 44 intermediates and interconnects between each pair of corresponding second passages 38 and cavities 40. A pair of chamfers are located at the corners of each slot 44 to ease the installation of the conductive bridge member 34 in the slot 44. For the same reason, a pair of chamfers 32*a* are also disposed at the open end of the opening 32.

As contact conductive member 22 is inserted into each first passage 14 of first housing 12 and the corresponding second passage 38 of the second insulative housing 16 therethrough, superior shielding or insulation is maintained between the corresponding regions of adjacently disposed conductive members 22.

Referring back to FIG. 1, it is viewed that intermediate contact region 26 of each conductive member 22 comprises two vertical and parallel walls 46 formed to slidably receive and electrically engage a conductive bridge member 34. A pair of clips 48 extending from the two walls abut against each other in order to releasably clip the conductive bridge member 34. Such an arrangement provides a substantially stable electrical contact when conductive bridge member 34 engages clips 48 formed on conductive member 22. For a female contact, an outward tab 50 is positioned on one of side walls to confront the step (not shown) of the groove 36 to stop forward movement of the conductive member 22. A barb 52, shown in FIG. 2, is positioned on the bottom surface of the conductive member 22 in order to interfere with the periphery of the first passage 14 thereby preventing withdrawal of the same.

The conductive bridge member 34 is preferably a flat metal U-shaped strip, having upwardly extending fingers, which can be manufactured by stamping. As may be seen in FIGS. 1 and 2, a first horizontal extension 56 extending in a direction substantially parallel to the first passages 14 of conductive bridge member 34 is inserted into the cavity 40 without withdrawal by means of a set of barbs 58 on its surface. When first housing 12 and second housing 16 are structurally assembled together, U-shaped conductive bridge member 34 is slidably positioned through the opening 32 of the first insulative housing 12 and, further, into first passage 14, whose bight portion 54 is held between the pair of clips 48 of the conductive member 22 for a stable electrical contact. Additionally, one end of the first horizontal extension 56 abuts against the opposite facing surface of the first insulative housing 12, as best viewed in FIG. 2. A second horizontal extension 60 positioned at the distal front end of the U-shaped body is inserted into the corresponding aperture 42 of the first insulative housing 12 and contacts the electrical components 30 positioned within the aperture 42. As mentioned, the preferable securement of conductive bridge member 34 promotes stability between all electrical contact points while simultaneously preventing the transfer of torsional forces or axial movement from conductive member 22 to electrical component 30.

As best viewed in FIG. 1, a metal shell 62 covers the front portion of first housing 12 which provides further shielding and a means for grounding. In the preferred embodiment, a grounding plate 64 is sandwiched between the metal shell 62 and the first housing 12 to enhance electrical contact. Additionally, grounding plate 64 is seated on a peripherally vacant portion of the first insulative housing 12. An embossment 66 is positioned on the surface corresponding to the electrical component 30 to provide better electrical contact between the component 30 and the grounding plate 64. It will be appreciated that electrical component 30 could just as easily electrically contact metal shell 62 directly without departing from the true spirit of the invention.

The assembly procedure for the connector of the present invention is described as follows.

(1) The conductive bridge members 34 are inserted into the slots 44 of second insulative housing 16 and the barb 58 of each conductive bridge member 34 intervenes in the cavity 40 to fix itself therein.

(2) The pin input receiving portion 26 and the intermediate contact region 28 of conductive members 22 are inserted into the first passages 14 of the first insulative housing 12 until the tab 50 of each conductive member 22 confronts the corresponding step 36*a* in place.

(3) The first insulative housing 12 and the second insulative housing 16 are assembled together and the elongated pin output portions 24 of conductive members 22 are inserted into the corresponding second passages 38 of the second insulative housing 16 individually. To the moment, in each pair of conductive members 22 and conductive bridge member 34 the bottom bight portion 54 of the conductive bridge member 34 is held by the clips 48 of the conductive member 22, and the horizontal portion 56 of the conductive bridge member 34 is inserted into the aperture 42. If desired, the first insulative housing 12 and the second insulative housing member 16 can be sealed together as an entity.

(4) The electrical components 30 are inserted into the apertures 42 on the open surface of aforementioned entity and covered by the grounding plate 64. The inner periphery of the grounding plate 64 encloses the front portion of the first insulative housing 12.

(5) The metallic shell 62 is put on the grounding plate 64 and covers the front portion of the first insulative housing 12.

(6) The whole means is fixed by two screws and the tabs on the edges.

It will be appreciated that the order of the steps above may be changed with each other, for example, step (2) and (3).

In the preferred embodiment, the connector assembly 10 is redesigned to reduce the dimension of the first and second housings 12 and 16 in axial direction so that the connector assembly 10 of the present invention can maintain the same size as the industry standard connectors.

In accordance with the present invention, the second insulative housing 16 assures the true position of each elongated pin output portion 24 of conductive member 22. As can be viewed in FIGS. 1 and 2, the second passages 38 of the second housing 16 are dimensioned to slidably conform to the reduced size of elongated pin output portion 24. Thus, the additional stability provides a relatively rigid elongated pin output portion 24 while further promoting the correct positioning of the tail. Accordingly, alignment of the pin output portion 24 is maintained which substantially reduces the need for pin adjustment assembly onto a board. More importantly, the second insulative housing 16 provides superior shielding or insulation between the corresponding regions (i.e., pin output portion 24, pin input receiving portion 26 and intermediate electrical contact region 28) of adjacently disposed conductive members 22, and between conductive members 22, the electrical components 30 and the conductive bridge members 34.

It will be appreciated that the conductive bridge member 34 is a flat type to replace the band type disclosed in copending applications. According to the present invention, the conductive bridge member 34 is installed and embedded within the cavity 40 of the second insulative housing 16 from the front side, so the retention means, barbs 58, can be positioned along the body direction. Thus, they are not required to be positioned laterally, as described in copending applications. Accordingly, the flat type conductive bridge member 34 of the present invention achieves a lower resistance than that of band type conductive members, thereby, obtaining better performance. Moreover, the aperture 42 for receiving the horizontal extension 60 of conductive bridge member 34 and the cavity 40 for receiving the first horizontal extension 56 of the conductive bridge member 14, and the slot 44 for receiving the V-shaped main body of the conductive bridge member 14 can reduce the dimension to engage with the flat type conductive bridge member 34. In other words, the connector assembly 10 becomes more solid. This change enhances insulation of the assembly 10 because vacancies in the first and second housings 12 and 16 debilitates its insulation. Additionally, the conductive bridge member 34 is held by clips 48 formed on conductive member 22 so that the connection between conductive bridge member 34 and conductive member 22 is more stable and, ultimately, more reliable than that of copending applications with a pressing type.

Figure 6:
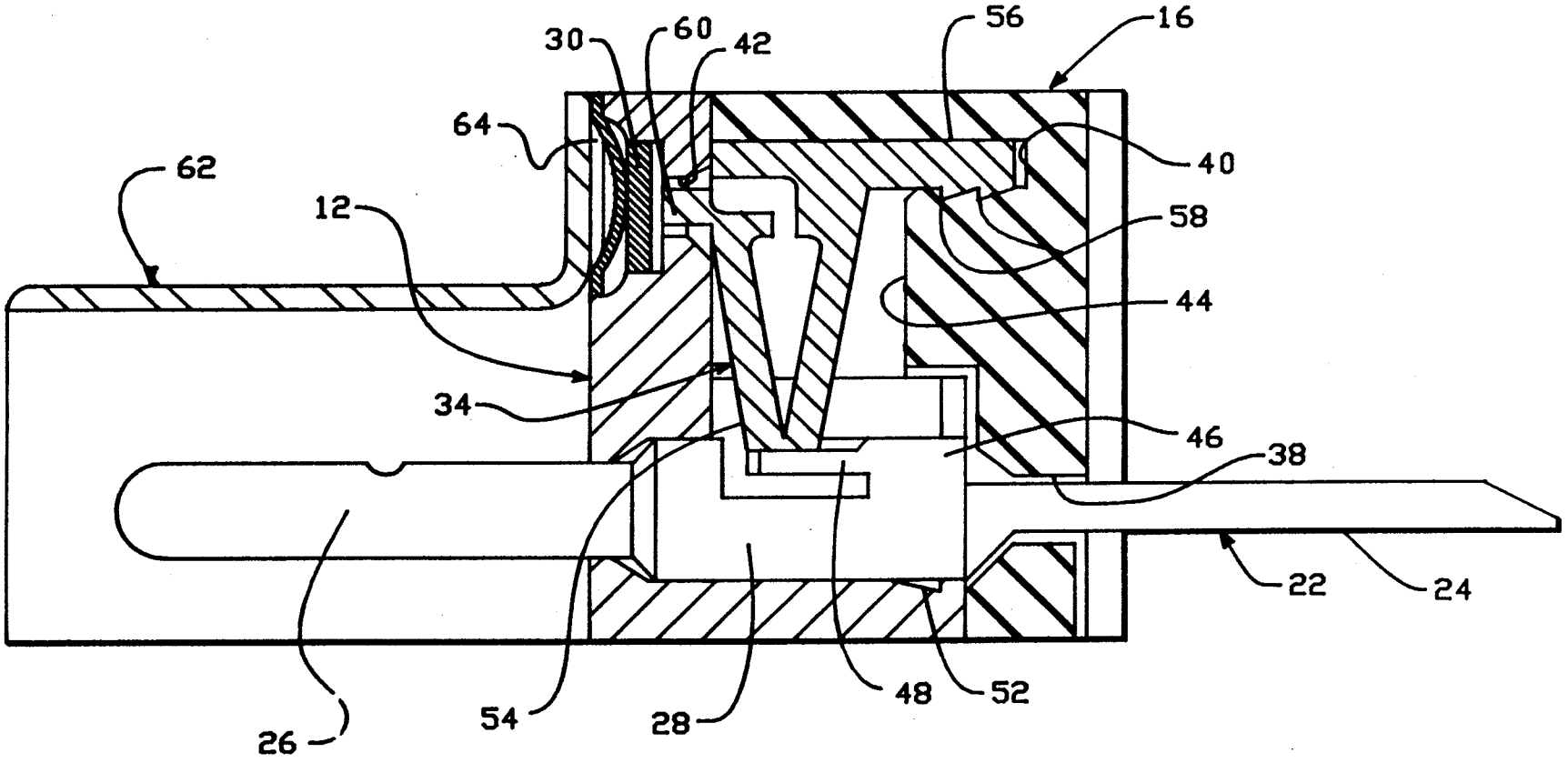
FIG. 6 is a vertical sectional view of a male connector similar to FIG. 1.

FIG. 6 illustrates an alternative embodiment to the electrical connector assembly of the present invention. As can be seen, a male connector including metallic shell, as compared to the preferable female connector already described, contains no front portion in order to cooperate with the mating female connector, and the conductive member 22 has no tab 50 on the side to restrict the forward movement but is positioned firmly in place due to the shape of the taper passageway. Regardless whether connector assembly 10 is a male connector or a female connector, the side walls of the conductive member 22 abut the second insulative housing 16 for rear retention in both embodiments.

Lastly, it is once again reiterated that electronic filtering components 30 may be any one or a combination of capacitors, resistors, varistors, diodes or the like.

While the invention has been described in connection with what is presently considered to be the most practical and preferred embodiments, it is to be understood that the invention is not limited to the disclosed embodiment but, on the contrary, is intended to cover various modifications and equivalent arrangements included within the spirit and scope of the appended claims.

Therefore, persons of ordinary skill in this field are to understand that all such equivalent structures are to be included within the scope of the following claims.

What is claimed is:

1. A programmable electrical connector assembly comprising:

a plurality of individual conductive members, each conductive member including an elongated pin output portion formed at one end, an input receiving portion formed at an opposing end thereof and an intermediate contact region disposed between the pin output portion and said input receiving portion;

a first insulative housing defining a plurality of individual first passages each extending therethrough and each dimensioned to axially accept an individual input receiving portion of an individual conductive member;

a second insulative housing secured to said first housing and defining a plurality of second passages each extending therethrough and each aligned with a corresponding one of the first passages and each dimensioned to axially receive only an individual elongated pin output portion of an individual conductive member;

a plurality of electrical filtering components; and a plurality of individual conductive bridge members electrically coupled to provide electrical communication between individual of said electrical filtering components and individual intermediate contact regions of corresponding conductive members;

wherein each conductive bridge member includes a first segment and an opposed second;

wherein said first housing defines a plurality of individual first grooves dimensioned to receive first segments of individual conductive bridge members; and wherein said second housing defines a plurality of individual second grooves dimensioned to receive second segments of individual conductive bridge members.

2. The programmable electrical assembly of claim 1 wherein said second housing permanently secures the individual second segments of said conductive bridge members.

3. The programmable electrical connector assembly of claim 1, wherein each of said conductive bridge members includes a first segment and a second segment and a center segment interposed therebetween; and wherein the intermediate contact regions of the individual conductive members include individual engaging means for slidably engaging the center segments of individual conductive bridge members.

4. The programmable electrical connector assembly as defined in claim 1 wherein, each of said conductive bridge members includes a first segment and a second segment and a center segment interposed therebetween;

said first housing defines a plurality of individual first grooves dimensioned to receive first segments of individual conductive bridge members;

said second housing defines a plurality of individual second grooves dimensioned to receive second segments of individual conductive bridge members; and the intermediate contact regions of said individual conductive members include individual engaging means for slidably engaging the center segments of individual conductive bridge members.

5. A programmable electrical connector assembly comprising:

a plurality of individual conductive members, each conductive member including an elongated pin output portion formed at one end, an input receiving portion formed at an opposing end thereof and an intermediate contact region disposed between the pin output portion and said input receiving portion;

a first insulative housing member defining a plurality of individual first passages each extending therethrough and each dimensioned to axially accept an individual input receiving portion of an individual conductive member, said first housing member including an upstanding island extending transverse to said first passage;

a second insulative housing member secured to said first housing and defining a plurality of second passages each extending therethrough and each aligned with a corresponding one of the first passages and each dimensioned to axially receive only an individual elongated pin output portion of an individual conductive member, said second housing member including a recess extending transverse to said second passages and dimensioned to snugly receive the upstanding island for interfitting engaging contact;

a plurality of electrical filtering components; and a plurality of individual conductive bridge members electrically coupled to provide electrical communication between individual of said electrical filtering components and individual intermediate contact regions of corresponding conductive members.

6. The programmable electrical connector assembly as defined in claim 2 wherein, each of said conductive members is substantially U-shaped, each including a bight portion and two finger portions extending therefrom.

7. The programmable electrical connector assembly as defined in claim 6 wherein, one of the finger portions of each of said U-shaped conductive bridge members includes a projection extending in a plane of the two finger portions in a direction away from the other of the finger portions.

8. The programmable electrical connector assembly as defined in claim 6 wherein, the individual bights of each of said U-shaped conductive bridge members slidably engage individual intermediate contact regions of different conductive members.

9. The programmable electrical connector assembly as defined in claim 1 and further including:

a ground plate in electrical communication with each of the filtering components.

10. A programmable electrical connector assembly comprising:

a plurality of individual conductive members, each conductive member including an elongated pin output portion formed at one end, an input receiving portion formed at an opposing end thereof and an intermediate contact region disposed between the pin output portion and said input receiving portion;

a plurality of electrical filtering components;

a plurality of substantially U-shaped individual conductive bridge members electrically coupled to provide electrical communication between individual of said electrical filtering components and individual intermediate contact regions of corresponding conductive members, each of said conductive bridge members includes a first segment and a second segment and a bight segment interposed therebetween;

a first insulative housing defining a plurality of individual first passages each extending therethrough and each dimensioned to axially accept an individual input receiving portion of an individual conductive member, said first insulative housing defines a plurality of individual first grooves dimensioned to receive the first segments of the individual conductive bridge members;

a second insulative housing secured to said first housing and defining a plurality of second passages each extending therethrough and each aligned with a corresponding one of the first passages and each dimensioned to axially receive only an individual elongated pin output portion of an individual conductive member, said second housing defines a plurality of individual second grooves dimensioned to receive the second segments of the individual conductive bridge members; and the intermediate contact regions of said individual conductive members include individual engaging means for slidably engaging the bight segments of individual conductive bridge members.

11. The programmable electrical connector assembly as defined in claim 10 and further including:

a ground plate in electrical communication with each of the filtering components.

12. An electrical connector assembly with programmable elements comprising:

a first housing defining a plurality of first passages extending therethrough;

a plurality of apertures defined within the first housing and disposed in parallel with the first passages;

a second housing positioned behind the first housing, defining a plurality of second passages therethrough each of which is in alignment with the corresponding first passages of the first housing individually;

a plurality of cavities defined within the second housing and disposed in parallel with and communication with the second passages of the second housing;

a plurality of contacts disposed individually within pairs of corresponding first and second passages of the first housing and the second housing;

a plurality of electrical components disposed within the apertures of the first housing;

a plurality of corresponding conductive bridge members each comprising a U-shaped body including a first horizontal portion which barbs at one end, and a second horizontal portion at another end, said bridge members disposed within the cavities of the second housing individually, each conductive bridge member contacting both a corresponding electrical component and a corresponding individual conductive member, respectively;

a shell enclosing a portion of the first housing, sandwiching a grounding plate with the first housing, the grounding plate communicating with the electrical components.

13. An electrical connector assembly with programmable elements comprising:

a first housing defining a plurality of first passages extending therethrough;

a plurality of apertures defined within the first housing and disposed in parallel with the first passages;

a second housing positioned behind the first housing, defining a plurality of second passages therethrough each of which is in alignment with the corresponding first passages of the first housing individually;

a plurality of cavities defined within the second housing and disposed in parallel with and communication with the second passages of the second housing;

a plurality of contacts disposed individually within pairs of corresponding first and second passages of the first housing and the second housing;

a plurality of electrical components disposed within the apertures of the first housing;

a plurality of corresponding conductive bridge members disposed within the cavities of the second housing individually, each conductive bridge member contacting both a corresponding electrical component and a corresponding individual conductive member, respectively;

a shell enclosing a portion of the first housing, sandwiching a grounding plate with the first housing, the grounding plate communicating with the electrical components;

wherein a slot intermediates and interconnects between each pair of passages and cavities of the second housing, and each passage of the first housing has an outward slot to receive the conductive bridge member.

14. A programmable electrical connector assembly comprising:

a plurality of individual conductive members, each conductive member including an elongated pin output portion formed at one end, an input receiving portion formed at an opposing end thereof and an intermediate contact region disposed between the pin output portion and said input receiving portion;

a first insulative housing defining a plurality of individual first passages each extending therethrough and each dimensioned to axially accept an individual input receiving portion of an individual conductive member, and defining a plurality of apertures disposed in parallel with said first passages;

a second insulative housing secured to said first housing and defining a plurality of second passages each extending therethrough and each aligned with a corresponding one of the first passages and each dimensioned to axially receive only an individual elongated pin output portion of an individual conductive member, and defining a plurality of cavities disposed in parallel with and communication with the second passages of the second housing;

a plurality of electrical filtering components disposed within the apertures of the first housing; and a plurality of individual conductive bridge members disposed within the corresponding cavities of the second housing, and electrically coupled to provide electrical communication between individual of said electrical filtering components and individual intermediate contact regions of corresponding conductive members.

15. The connector assembly as described in claim 14 wherein a slot intermediates and interconnects between each pair of passages and cavities of the second housing, and each passage of the first housing has an outward slot to receive the conductive bridge member.

16. The connector assembly as described in claim 14 wherein each conductive bridge member includes a U-shaped body including a first horizontal portion with barbs at one end, and a second horizontal portion at another end.

* * * * *